United States Patent [19]

Grünenfelder et al.

[11] 4,219,864

[45] Aug. 26, 1980

[54] DEVICE AND METHOD FOR MOISTENING AND/OR DISCHARGING ELECTRICALLY INSULATING OBJECTS AND MATERIALS

[75] Inventors: Hans Grünenfelder, Basel, Switzerland; Hermann Künzig, Weil, Fed. Rep. of Germany

[73] Assignee: Eltex-Elektronik H. Grünenfelder El. Ing., Switzerland

[21] Appl. No.: 893,340

[22] Filed: Apr. 4, 1978

[30] Foreign Application Priority Data

Apr. 4, 1977 [CH] Switzerland ..... 4175/77

[51] Int. Cl.[2] ..... B05B 5/02

[52] U.S. Cl. ..... 361/228; 239/704

[58] Field of Search ..... 361/212, 214, 227, 228; 239/690–708

[56] References Cited

U.S. PATENT DOCUMENTS

| | | | |
|---|---|---|---|
| 2,221,338 | 11/1940 | Wintermute | 361/227 X |
| 2,894,175 | 7/1959 | Lamm | 361/228 |
| 3,323,934 | 6/1967 | Point | 239/695 X |
| 3,930,614 | 1/1976 | Krenkel | 239/695 |

FOREIGN PATENT DOCUMENTS

| | | | |
|---|---|---|---|
| 1053688 | 3/1959 | Fed. Rep. of Germany | 361/214 |
| 439078 | 1/1975 | U.S.S.R. | 361/212 |

*Primary Examiner*—Harry E. Moose, Jr.
*Attorney, Agent, or Firm*—McGlew & Tuttle

[57] ABSTRACT

A device for moistening and discharging electrically insulating objects, comprises, an atomizer for atomizing a liquid, such as water, into a spray and for directing the spray through a path and onto the object. The spray is directed through a path which is provided with an electrode charger or a group of chargers arranged in a pattern for charging the spray particles with a charge opposite to the object so that when they contact the object, they discharge the object as well as moisten it. The device is usable in the printing industry by passing a paper web which has been either previously printed or will be printed through a path after it has been charged with a charge, such as a positive charge, and then directing a spray onto the web after the spray moves through a series of electrodes to impart an opposite charge to the spray particles from that of the paper, so that the particles both moisten the paper and discharge the charge therefrom when they are directed thereto. The apparatus advantageously includes a spray nozzle for spraying water using an air source and for directing the spray which is formed through a tubular element having a plurality of sharp pointed electrodes arranged there to project into the tubular element and provide charges of the particles which pass therethrough.

14 Claims, 5 Drawing Figures

DEVICE AND METHOD FOR MOISTENING AND/OR DISCHARGING ELECTRICALLY INSULATING OBJECTS AND MATERIALS

FIELD AND BACKGROUND OF THE INVENTION

This invention relates to a method and device for moistening and/or discharging electrically insulating objects and materials, particularly webs and sheets of paper and plastic, comprising, an atomizer for atomizing water, a high-voltage source, and at least one charging electrode for charging droplets produced by the atomizer, in which the charging electrode or electrodes are arranged in a manner such that, in the zone of the charging electrode or electrodes, the droplets form a mist.

DESCRIPTION OF THE PRIOR ART

While printing upon paper, the ink or color printed on is dried, for example, by means of hot air. Thereby, the paper itself is also dried, with the result that it becomes brittle and friable. In multicolor intaglio printing processes, sections of the paper web are consecutively printed upon with different colors. In such cases, the paper sections are dried after each printing operation.

This drying operation, in addition to the already mentioned embrittlement, causes a shrinkage of the paper. Now, during the different printing operations, if a paper section changes its dimensions, the individual colors fail to be printed at the locations provided relative to each other and a deflective image is produced.

An already marketed device for moistening a paper web is known, which comprises a spray nozzle for atomizing water. A grid-like electrode is provided near the paper web, to which voltage is applied. The air-water droplets mixture produced by atomization is sprayed through the grid electrode against the paper web. The paper web on which an electrically conducting water film is to form, due to the moistening, is grounded by means of a cylinder. The device of the prior art proved disadvantageous in practice. That is, in order to obtain a fairly satisfactory moistening, such large amounts of water must be sprayed on so that the humidity of the air in the zone of the entire printing machine and the ambiance thereof is strongly increased.

In order to enable the water droplets to penetrate through the grid electrode and pass to the paper web, the air-water droplets mixture produced by the atomizer must be sprayed against the grid electrode at a high velocity. Because of this high flow velocity, the portions of the air-water droplets mixture stream impinging on the grid electrode are deflected and become turbulent and this also contributes to a strong increase of the air humidity in a relatively large area. This strong increase of air humidity in a relatively large ambience, however, assists the formation of rust on the printing machines which considerably increases their maintenance costs. Of course, in addition, the life of the machines is thereby reduced.

Another drawback of this prior art device is that the high flow velocity of the air-water droplets mixture may cause fluttering motions of the paper. This may disturb the guidance of the paper web and cause irregularities in the paper conveyance.

A further device for spraying coloring substances on housings and other workpieces is known from Swiss Pat. No. 410,697. In this prior art device, a rod-shaped charging electrode for charging the coloring substance is employed which may have a pointed end. This known color spraying device, however, serves another purpose as compared with the present invention and solves another problem. First, the prior art device does not spray water but instead sprays a coloring matter. Second, the electrode is located close behind the orifice of the atomizer nozzle, in the axis of the nozzle. Also, the design of the nozzle is such that the coloring substance does not form a mist in the zone of the electrode, but it forms a continuous thin film having approximately the shape of a conical surface surrounding the electrode. The breakdown of the thin film into droplets, i.e., the formation of mist, however, takes place only after the coloring matter has passed through the zone of the electrode and has been charged. Using water, however, the charging of a continuous thin film would be very disadvantageous because water is electrically well-conducting and a continuous thin film of water would shunt the high voltage off to the atomizer nozzle. Then, the high voltage could pass through the water up to the water supply system.

Further, in the prior art device, electric field intensities of about 2 to 4 kV/cm must be used for spraying the coloring substance and, for example, 25 to 50 kV are applied between the electrode and the ground. The use of such high voltages, however, entails a considerable hazard and requires a corresponding insulation as well as expensive protective measures. Moreover, in the color spraying device of the prior art, the coloring substance must be sprayed at a high velocity. That is, upon leaving the nozzle, in the zone of the electrode, the jet has a flow velocity of the order of magnitude of 50 m/s. To produce such a high velocity, a high pressure is needed, on the one hand, and, on the other hand, with a paper web to be moistened, the effect would be a disadvantageous fluttering of the web. Similar problems, as in printing on paper, also arise with the printing on plastics, or coating of paper or plastics, so that here again, moistening may be necessary.

SUMMARY OF THE INVENTION

The present invention is directed to a device which permits a satisfactory and uniform moistening of strip-like paper or plastic pieces, in particular, paper and plastic webs, with small amounts of water, while applying a relatively low high voltage to the electrode or electrodes.

The use of at least one pointed or keen-edges charging electrode makes it possible to produce corona discharges by means of relatively low high voltages, for example, of 5-10 kV relative to the ground and, thereby, to substantially charge all of the water droplets.

The device may be used for moistening printed and dried paper webs. Such webs, after the drying operation, are usually electrically charged. If the water droplets formed during the atomization are electrically charged to a polarity which is opposite to that of the paper, the paper attracts the droplets, whereby, an intense, deeply penetrating moistening is obtained. At the same time, this neutralizes the charge present on the paper, which also is very useful for the further treatment thereof.

The invention makes it possible to obtain a satisfactory paper moistening by atomizing smaller amounts of water than those which were necessary in the moistening processes of the prior art. Since almost all of the water droplets produced during the operation of the inventive device can be electrically charged and are therefore attracted by the paper which is also charged, the mist formed by the water droplets is, in addition, kept within a narrowly limited space so that it barely comes into contact with the metal parts of the printing machine and, accordingly, does not cause further corrosion.

If the inventive device is used for moistening paper or plastic webs, a counterelectrode, in addition, is preferably provided which has a plane surface. The counterelectrode is located at the side remote from the outlet opening of the atomizer of the web to be moistened. The counterelectrode can be supplied with a high voltage having a polarity which is opposite, relative to the ground, to that which is applied to the charging electrodes. Due to the effect of the counterelectrode, the charged water droplets are attracted additionally toward, and drawn into, the paper. This still augments the above mentioned advantages of the inventive device.

It has further been found that the inner zones of a paper are particularly well moistened if the water droplets have an average diameter of 0.005 mm at most, for example, about 0.001 mm. For this reason, the atomizer is preferably provided with a passageway following the atomizer chamber which comprises an upwardly extending portion and an arcuate portion. With suitable dimensioning, larger droplets are precipitated in this passageway. In this manner, only droplets having a maximum diameter of about 0.005 mm pass to the outside.

The inventive device may also be used for discharging electrostatically charged objects which, of themselves, need not be moistened. For example, objects such as watch stones, plastic cups, and tablets to be packed in filling and packing machines are transported to the boxes and containers to be filled by means of a conveying means, for example, a conveyor belt or shaker conveyor. During transportation, the objects are frequently electrically charged, so that they attract or repel one another, which may disturb the filling or packing operation to such an extent that the machine fails to fill or pack the provided amount. Occasionally, in such cases, discharging electrodes having points facing the conveying means and connected to a high voltage source have been installed. Frequently, however, the discharge with such electrodes was unsatisfactory, particularly if objects were involved having pronouncedly uneven, spatial shapes, such as cups or other bodies with cavities. In addition, because of the fire or explosion hazard, it may even be impossible to employ such discharging electrodes.

It has now been found that the inventive device is very well suited for discharging electrically insulating, electrostatically charged objects. The mist of charged droplets produced by the device can easily penetrate into openings or pass to recessed surfaces, so that even objects having a complicated three-dimensional shape can be discharged. Further, any sparkling can be securely avoided, so that fire or explosion hazards are eliminated.

The invention further relates to a method of moistening and/or electrically discharging objects in which water is atomized and the mist produced thereby is directed past at least one charging electrode.

Accordingly, it is an object of the invention to provide an improved device for moistening and/or discharging electrically insulating objects and materials which comprises an atomizer for atomizing a liquid and directing it in a spray through a path into the object and a electrode charger disposed in the spray path and charging the droplets of the spray as they are moved where they charge opposite to the object so that when they contact the object, they discharge the object as well as moisten it.

A further object of the invention is to provide a method of treating paper which has either just been printed or on the way for printing, which comprises directing the paper through a path between a plurality of charging electrodes on one side of the path and a counterelectrode on the other side and directing a spray of liquid through the electrodes on the charging side to the paper after the paper has first been charged with a charge which is opposite the charge imparted to the spray droplets.

Another object of the invention is to provide a device for moistening and discharging objects which already have a charge thereon, which comprises means for moving the objects through a path and means for generating a spray of liquid and for directing the spray through a means for charging the droplets thereof to a charge opposite to that of the objects and for subsequently directing the objects onto the articles to be discharged.

A further object of the invention is to provide a device for moistening and discharging objects or materials which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
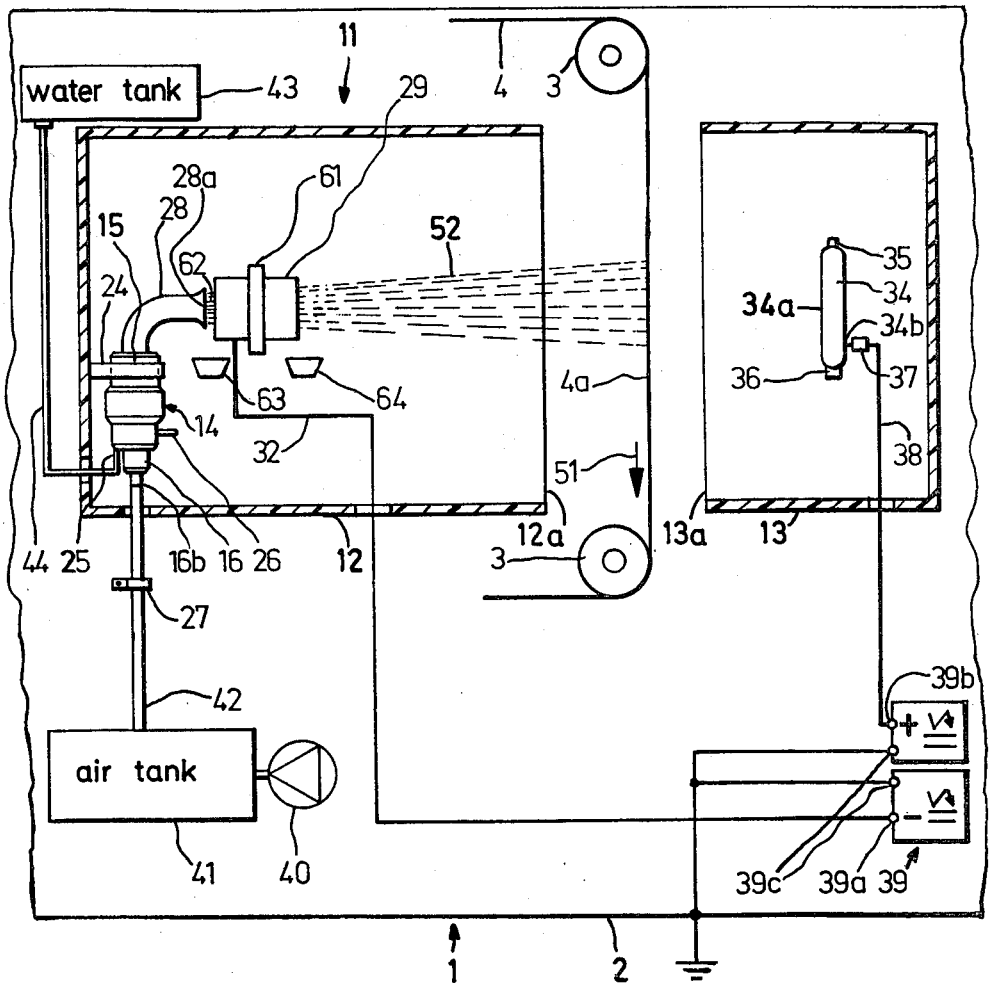
FIG. 1 is a diagrammatical sectional view of a part of a printing machine comprising a device for moistening a paper web constructed in accordance with the invention.

Referring to the drawings in particular, the invention embodied therein in FIG. 1 shows a part of a largely schematized printing machine 1 which, in the present example, is a rotary gravure printing press. Printing press 1 comprises a frame 2 on which, among others, two metal cylinders 3 are mounted for rotation. A paper web 4 is guided by cylinders 3 in such a manner that a section 4a of the web extends in a vertical plane between the cylinders.

Figure 2:
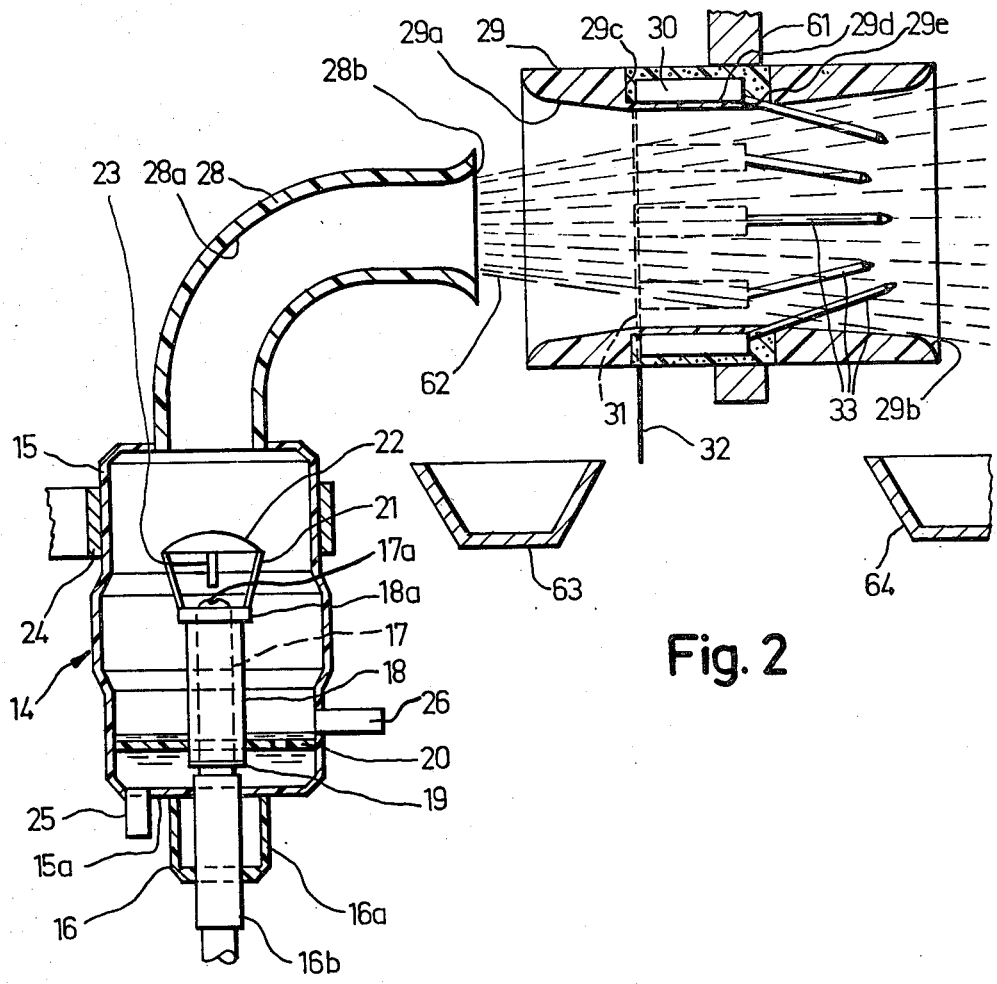
FIG. 2 is an enlarged longitudinal sectional view of the atomizer and the body accommodating the charging electrodes, with the nozzle of the atomizer and some parts connected thereto remaining in elevational view.

Also shown in FIG. 1 is a device for moistening and discharging the paper web 4, generally designated 11. The device 11 comprises two protective boxes 12 and 13 which are made of plastic and are detachably secured to frame 2, the opening edges of which each extend in a vertical plane parallel to paper web section 4a. A slot-shaped intermediate space is provided between the two opening edges 12a and 13a, through which the paper web section 4a extends. In the interior of protective box 12, an atomizer 14 is detachably secured by means of a support 24 represented in a simplified manner and shown on a larger scale in FIG. 2. Atomizer 14 comprises a substantially cylindrical atomizer chamber 15 with a vertical axis of rotational symmetry, which is formed by an electrically insulating sleeve of plastic and sealed to the outside. A pressure-gas connection 16 is provided in the center of bottom 15a of the atomizer chamber 15. Connection 16 comprises a socket 16a and a tube 16b which extends there through, and is connected to a nozzle 17 which projects approximately to the center of atomizer chamber 15 and has a small nozzle orifice 17a on its free end. Nozzle 17 is surrounded by a coaxial sleeve 18. On its lower end, slightly above bottom 15a, sleeve 18 is secured to nozzle 17 by an annular disc 19 which is provided with passage holes.

The upper end 18a of sleeve 18 is increased in thickness and is slightly spaced in the downward direction from nozzle orifice 17a. Sleeve 18 is further connected to the wall of atomizer chamber 15, by means of a supporting ring 20 which extends slightly above the lower end of the sleeve and is provided with passage holes. A domed hood 22 is secured by means of two rods 21 to the upper end 18a of sleeve 18, so that an intermediate space is formed between the hood and nozzle orifice 17a. A pin-shaped surge body 23 extending toward nozzle 17 is centrally secured to hood 22 and its end face is only slightly spaced from nozzle orifice 17a.

A liquid supply connection 25 is secured to and extends through bottom 15a. Slightly above annular disc 19 and supporting ring 20, but still far below nozzle orifice 17a, an overflow pipe 26 is provided, which extends through the wall of atomizer chamber 15. Socket 16a, as well as atomizer chamber 15, may be made of an electrically insulating plastic, whereas, tube 16b, nozzle 17, sleeve 18, annular disc 19, rods 21 and hood 22 are made of an electrically conducting metal.

To the upper end of atomizer chamber 15, a tube 28 of electrically insulating plastic is secured and defines a passageway 28a, which communicates with the interior of the atomizer chamber. The tube 28 has a clear cross-sectional area of at least 1 $cm^2$ and extends from atomizer chamber 15 first vertically upwardly and then along a circular arc of 90° and terminates with a flaring end portion 28b forming an outlet. A sleeve-shaped body 29 is disposed adjacent this free end portion 28b of tube 28, and it is also made of an electrically insulating plastic and is secured to the box 12 by means of a support 61. The inner surface of the body 29 defines a horizontally extending passageway 29a having a circular cross-section and a diameter of at least 3 cm. Passageway 29a is aligned with the horizontally extending end portion 28b of tube 28 and its end remote from tube 28 forms an outlet 29b for the air-water droplets mixture produced in the atomizer.

Figure 3:
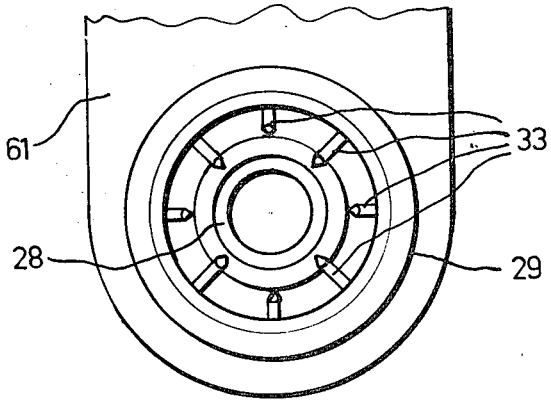
FIG. 3 is a front view of the outlet opening of the body accommodating the charging electrodes.

Body 29 is provided on its outside with a circular groove 29c, the bottom of which is provided with eight trough-speed recesses 29d, distributed over the circumference. In each of the recesses, an electrical resistor 30 is accommodated. First connection leads of resistors 30 are connected, for example, soldered, to a wire ring 31 which is received in circular groove 29c. Wire ring 31 is electrically connected to a conductor 32 formed by a high tension cable. Each of the second connection leads of resistors 30 are connected to a charging electrode 33 which is formed by an obliquely extending spike of stainless steel extending through an oblique bore 29e of body 29 and projecting into passageway 29a. The free ends of charging electrodes 33 are needle-shaped and provided with ground points. As shown in FIG. 3, the points of the eight charging electrodes 33 are uniformly distributed along two pitch circles. Resistors 30, wire ring 31, the end of conductor 32 connected thereto, and the ends of electrodes 33 connected to the resistors are sealed in body 29 by means of an insulating sealing compound.

Body 29 is positioned so that its outlet 29b faces section 4a of paper web 4. The outlet is spaced from the paper web 4 by a distance of about 200 to 500 mm. Further, depending on the width of paper web 4, identical atomizers 14 and bodies 29 are provided which are juxtaposed along the entire width of the paper web.

A free intermediate space 62 is formed between outlet 28b of tube 28 and body 29. In other words, the wall surfaces defining the passageway for the air-water droplets mixture produced by atomizer 14 and interrupted on the entire circumference of the passageway at a location between atomizer 14 and charging electrodes 33. This ensures that no continuous, electrically conducting liquid film can form along the wall surfaces defining the flow path of the air-water droplets mixture through which the high voltage could pass from the electrodes 33 to the atomizer and to the water supply system. A collecting trough 63 is secured to frame 2 or protective box 12 below intermediate space 62. A collecting trough 64 is also provided below outlet 29b. The water drops falling from the ends of the passageways in these troughs are collected and drained to the drain system of the building or a collecting tank.

By means of electrically insulating holders 35 and 36, a counterelectrode 34 is secured to protective box 13. Counterelectrode 34 is formed by a metal plate extending over the entire width of paper web 4. The counterelectrode is separated from outlet 29a by an intermediate space and comprises a plane surface 34a facing paper web section 4a and outlet 29a. The paper web 4 is spaced from this surface 34a of the counterelectrode by a distance of about 100 to 200 mm. Counterelectrode 34 is provided with a connecting element 34b to which a conductor 38 formed by a high-tension cable is connected through a resistor 37.

Conductors 32 and 38 are connected to terminals 39a and 39b of two high-voltage devices forming together a high-voltage source 39. The terminals 39c of the source form the ground connection and are connected to frame 2 of the printing machine. Cylinders 3 are also electrically connected to frame 2 and, thereby, to the ground, through their bearings or additional conductors. Further, frame 2 and the terminals 39c are grounded in their turn.

A compressed-gas source 40, more specifically, a compressor for producing compressed air, the outlet of which is connected to a container 41 is also provided. The container is connected, through a line 42, to the pipe 16b of compressed-gas connection 16. Line 42 is a metal pipe which is secured to frame 2 by means of electrically conducting clamps 27, to electrically connect the electrically conducting parts to the atomizer to frame 2 and, thereby, to the ground terminals 39*c*. A water tank 43 is also provided. Water tank 43 is connected, through a line 44, to liquid supply connection 25. Water tank 43 is also connectable through another line (not shown) equipped with a manually or electrically actuable cock, to a connection of a hydraulic main. Water tank 43 and line 44 are preferably made of metal and are electrically connected to frame 2 and, thereby, to the ground terminals 39*c*. Overflow pipe 26 is connected through another line (not shown) to the drain system of the building or to a collecting tank.

During operation of printing machine 1, paper web 4 is moved in the direction of arrow 51. Prior to arriving at upper cylinder 3', paper web 4 is printed, for example, with one color, and is then dried with hot air or in another manner, and, upon passing around lower cylinder 3, it is printed with another color. Prior to passing through the gap between the two protective boxes 12 and 13, paper web 4 will usually be electrostatically charged. The magnitude and polarity of the charge carried by the paper depends on the type of preceding treatment and the design of the printing machines. As a rule, however, for a specific printing machine and treatment, the polarity of the charge is always the same. In the present example, it is assumed that while entering the gap between protective boxes 12 and 13, paper web 4 carries a positive electric charge. In such a case, the high-voltage source is connected so as to apply a negative DC voltage, relative to the ground, i.e., the ground terminals 39*c*, to charging electrodes 33, and a positive DC voltage to counterelectrode 34.

Further, compressed gas, more specifically compressed air, having an excess pressure of 6 atm at most, is fed from container 41 to nozzle 17. In addition, water is fed continuously or intermittently to atomizer chamber 15 from tank 43 in an amount such as to maintain the water surface in the atomizer chamber at least at the level of annular disc 19.

On the other hand, overflow pipe 26 and the line connected thereto and extending downwardly ensure that the water surface cannot ever rise up to nozzle orifice 17*a*. As soon as compressed air flows through nozzle 17 into the interior of atomizer chamber 15, water is entrained by suction upwardly, through the channel formed between nozzle 17 and sleeve 18 and through the holes in annular disc 19, and is now atomized. Large droplets are stopped by hood 22. In the arcuate portion of passageway 28*a* formed by tube 28, a further separation of droplets takes place due to the centrifugal force and, in particular, due to gravity.

The cross-sectional area of passageway 28*a* is proportioned to the amount per unit time of the air-water droplets mixture furnished by the atomizer so that droplets having large diameters drop back in the upright portion of passageway 28*a* or impinge on the tube wall in the arcuate portion thereof and run back into the atomizer chamber along the wall. In passageways 28*a* and 29*a* and with electrodes 33 and 34 dead, the air-water droplets mixture has a flow velocity of 20 cm/s at most, and after passing passageway 29*a* and leaving outlet 29*b*, preferably of 10 cm/s at most, for example, about 0.5 to 2 cm/s. With the design of the atomizer and passageways described herein (28*a* and 29*a*), the droplets which arrive at outlet 29*b* have a maximum average diameter of 0.005 mm. The average diameter of the droplets may be, for example, 0.001 mm.

As the air-water droplets mixture arrives into the zone of the electrodes 33, the water droplets are uniformly distributed over the entire cross-section of passageway 29*a*, so that a rather homogeneous mist is present. The DC voltage applied to electrodes 33, which is negative relative to the ground, and the magnitude of which is adjustable at the high-voltage source 39 and amounts to 20 kV at most, for example to a maximum of 10kV, produces corona discharges. Thereby, an ionization takes place by which the water droplets are charged negatively.

The low flow velocity of the mist in the zone of charging electrodes 33 and the arrangement of the latter, ensure that in practice, all droplets are charged. A mist beam 52, composed of air and negatively charged water droplets, now leaves outlet 29*b* and flows against paper web section 4*a*. The water droplets are taken along by the relatively slow air stream and, in addition, are accelerated against the paper web by the positive charge of the latter and by counterelectrode 34 to which a positive DC voltage is applied.

Preferably, the magnitude of the voltage applied to the counterelectrode is also adjustable and amounts to about 10 to 100 kV relative to the ground. The action of the electric field accelerates the droplets to velocities in the order of magnitude of 10 to 50 cm/s. Consequently, the droplets impinging on the paper surface can easily penetrate in the areas of the paper which have not yet been printed and thus moisten the paper relatively uniformly through the entire thickness thereof. At the same time, the positive charges formerly present on the paper and the negative charges of the water droplets neutralize each other. Since, due to the moistening, the paper becomes electrically conducting, residual charges which might still be present are led away through cylinder 3 which follows device 11 in the paper conveying direction, to frame 2 and to the ground.

Provided that the operational parameters, i.e., the water amount atomized per unit of time and the voltages applied to the electrodes are adequately proportioned relative to the charge carried by the paper and the advance speed thereof, after passing beam 52, paper which is substantially free from charges is obtained.

The amount of water required for moistening is relatively small. With a diameter of about 2 to 4 cm of outlet opening 29*b* and a single atomizer, a strip of about 5 to 20 cm in width can be moistened, depending on the spacing of the outlet opening from the paper web. For this purpose, about 1 to 10 g per minute of water are to be atomized, depending on the thickness and speed of the paper. For broad paper webs, as already mentioned, a plurality of juxtaposed atomizers is provided. Since only relatively small amounts of water are atomized and the water remains within a small space, due to the electric fields, substantially no water droplets can escape from the zone ot the two protective boxes 12 and 13. In consequence, the water droplets cannot cause any corrosion of the printing machine parts.

Preferably, counterelectrode 34 should produce only an electric field and no discharges. To this end, it is rounded on all sides and does not possess any sharp edges or points. Resistors 30 and 37 serve as current limiters and are dimensioned, for example, so that they allow a flow of a maximum current of 0.1 to 0.5 mA. Thus, resistors 30 may have a resistance of about 100 Mohms and resistor 37 of about 500 megohms. The two protective boxes 12 and 13 largely prevent operators from coming into contact with the electrodes. In addition, counterelectrode 34 may be enclosed on all sides by an electrically insulating plastic, with the plastic thickness on the surface facing the paper web not exceeding a thickness of about 0.5 mm.

With device 11 in operation, corona discharges are produced only by charging electrodes 33, i.e., within passageway 29*a*. Since in this zone, air with water droplets in the form of mist are also present, there is only an extremely small risk of sparking which could cause a fire or explosion. The charging electrodes might even project to a small extent from the outlet opening. However, they are always to be located completely within the zone of the produced air-water droplets mist.

Should the operation of printing machine 1 require a moistening of the paper web after each of a plurality of operational steps, for example, during a four color printing after the application of each color, the printing machine may of course be provided with atomizers and counterelectrodes at all locations which may require them. In such cases, it is easily possible to contact all of the electrodes to the same high-voltage source and all atomizers to the same two containers and tanks 41 and 43, respectively. In order to moisten particularly thick paper, two devices may be employed in order to moisten the paper web in sequence from both sides.

Device 11 may be used not only for moistening and discharging paper webs, but also for moistening and discharging individual sheets of paper or flat objects of other electrically insulating materials, such as plastics. On the other hand, the spraying of electrically charged water droplets may also be advantageously utilized in instances where no moistening, but only a discharge of a paper or plastic web, is needed.

The inventive device may also be adapted for discharging any other electrically insulating objects which are transported by means of a conveyor, such as, a conveyor belt or a shaker conveyor. The objects involved may be watch stones, plastic parts produced on a large scale, textile pieces, or tablets. The spraying of electrically charged water droplets makes it possible also to discharge objects having complicated three-dimensional shapes and, thereby, to eliminate a mutual attraction or repulsion thereof. In many instances, this may increase the reliability of automatic filling and packing machines considerably.

As another field of application for the inventive device, separators are to be mentioned, in which granular materials are separated according to their size by means of movable screens. Here again, the removal of electrostatic charges by spraying with charged liquid droplets may lead to considerable advantages.

In filling and packing machines, as well as in separators, the objects to be discharged are usually conveyed on horizontal or inclined conveyor means, or they are separated on horizontal or inclined screens. In such cases, of course, the device for spraying charged liquid droplets is arranged so as to direct the outcoming beam from above downwardly, approximately at a right angle against the surface on which the objects or materials to be discharged are placed.

Figure 4:
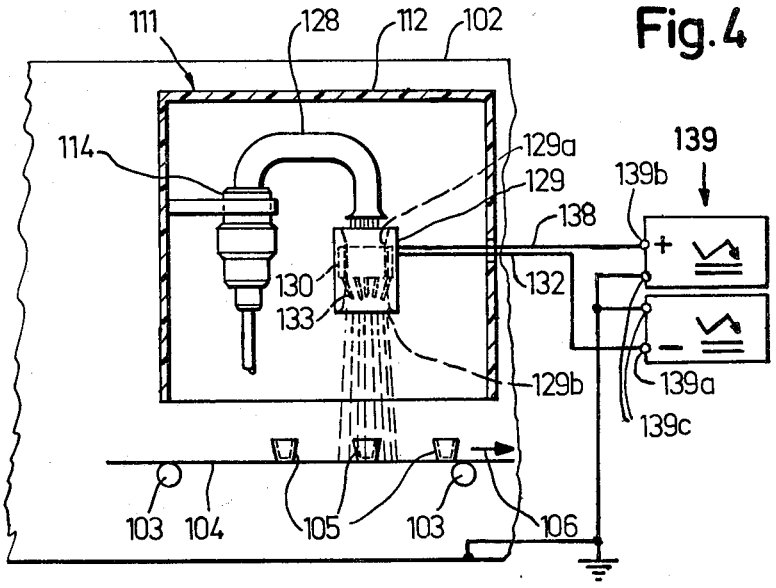
FIG. 4 is a diagrammatical sectional view of a device for discharging bodies of electrically insulating materials, which are transported on a conveyor belt.

A very simplified example of such a device for discharging objects is shown in FIG. 4. FIG. 4 shows a filling or bagging machine comprising a frame 102. In the frame, a conveyor belt 104 is guided by means of rollers 103 and, on the belt, cup-shaped objects 105 of electrically insulating plastic to be packed are advanced in the direction of arrow 106.

A device 111 for moistening objects 105 is secured to the frame 102 above conveyor belt 104. The device comprises a protective hood 112 open toward the conveyor belt, in which an atomizer 114 is accomplished. The atomizer is of substantially the same design as atomizer 14. The tube 128 connected to the outlet of the atomizer chamber, however, in contradistinction to tube 28, is C-shaped, so that its outlet opening is directed downwardly. A body 129 of electrically insulating material forming a passageway 129*a* and having an outlet opening 129*b* for the charged water droplets which faces conveyor belt 104 is provided below the C-shaped outlet opening and is spaced from tube 128 by an intermediate space. Body 129 is approximately of identical design with body 29 and comprises resistors 130 and charging electrodes 133. Resistors 130, however, are arranged in two groups of equal number, for example, of four resistors.

The leads of one of the resistor groups which are not connected to electrodes 133 are connected through a conductor 132 to the minus terminal 139*a* of a high-voltage device of the high-voltage source 139. The corresponding leads of the other group of resistors are connected through a conductor 138 to the plus terminal 139*b* of a second high-voltage device of the high-voltage source. The ground terminals 139*c* of the high-voltage source are electrically connected to frame 102 and the ground.

During operation, analogously to atomizer 14, water and compressed air are supplied to atomizer 114. The mist produced by the atomizer flows through tube 128 into the passageway of body 129. DC voltages having opposite polarities relative to the ground are applied to the two groups of charging electrodes 133 accommodated in the body. These DC voltages produce corona discharges by which the water droplets are charged. The charged droplets flow along with the air coming from the atomizer through outlet opening 129*b* downwardly, against the conveyor belt and objects 105 transported thereon. Droplets having charges which are opposite to that of objects 105 are attracted by the latter. The objects can thereby be discharged.

Negative and positive voltages may be applied to the charging electrodes having a manitude, relative to the ground, of 20 kV at most, for example, 5 to 10 kV. Depending on whether all of the objects carry charges of identical polarity or the polarities of the charges are different, the magnitude of the resistances of the two resistor groups and of the voltages applied to the charging electrodes can be predetermined to the effect that the droplets are charged chiefly negatively or chiefly positively, or that droplets of both polarities are produced permanently. Otherwise, the device shown in FIG. 4 can be operated with similar rates of flow and droplet sizes as the device shown in FIGS. 1 to 3.

Further, for charging, AC voltage may be used instead of DC voltage. In this case, the same AC voltage may be applied to all of the resistors and electrodes.

Thus, no counterelectrode is provided in the device shown in FIG. 4. However, advantageously, a conveyor belt should be used which has an electrically conducting supporting surface which is connected to the ground in an electrically conducting manner. If instead of the conveyor belt, another supporting means is employed for supporting and conveying the objects to be discharged, this supporting means should, analogously, comprise an electrically conducting surface having ground potential. It should be noted that with the moistening and/or discharging of paper and plastic webs, it would also be possible to omit the counterelectrode and to apply an AC voltage to the charging electrodes or a negative high voltage to a part of the charging electrodes and a positive high voltage to the other part of the electrodes.

If, on the other hand, a counterelectrode is used to which high voltage, relative to the ground is applied, the charging electrodes might be electrically conductively connected to the ground. The voltage between the charging electrodes and counterelectrode is fixed in such a manner that corona discharges occur at the points of the charging electrodes.

In the embodiments described, bodies 29 and 129 are provided with circular passageways and outlet openings. However, it is also possible to provide bodies with passageways and outlet openings having a rectangular cross-section extending over the entire width of the paper or plastic web or conveyor belts.

Figure 5:
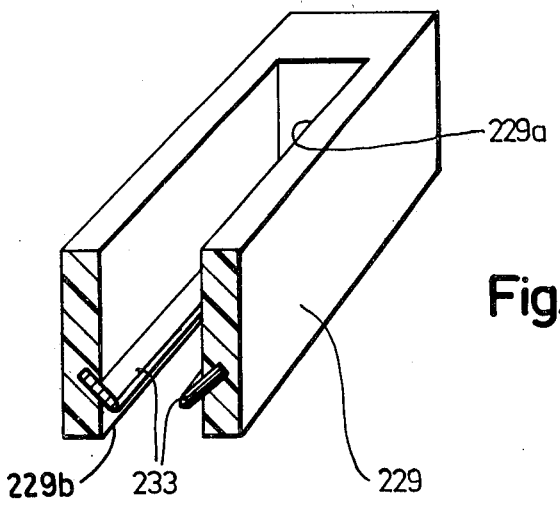
FIG. 5 is an axonometric view of a cut body accommodating charging electrodes provided with a keen edge.

FIG. 5 shows an example of such a body 229 of electrically insulating plastic. Body 229 comprises a passageway 229*a* having an oblong cross-section and an outlet opening 229*b*. A charging electrode 233 is inserted in each of the two longitudinal side walls of body 229 and each electrode is provided with a keen edge projecting into the passageway.

While specific embodiments of the invention have been shown and described in detail to illustrate the application of the principles of the invention, it will be understood that the invention may be embodied otherwise without departing from such principles.

What is claimed is:

1. A device for moistening and/or discharging electrically insulating objects and materials, in particular webs and sheets of paper and plastic, comprising: an atomizer for atomizing water to produce droplets; a body having a passage therethrough for receiving the atomized water and having an outlet opening; a plurality of sharp charging electrodes extending into the passage of said body for charging the droplets and for forming a cloud in the area of said charging electrodes; said body including an electrically insulating wall surface bounding said passage in at least the area of said charging electrodes and said outlet opening; and a high voltage source connected to said charging electrodes for charging the droplets.

2. A device according to claim 1 wherein said body includes an inlet opening having a circumference spaced from said atomizer so that said insulating wall surface forming a part of a flow path for the droplets is discontinuous from a portion of the flow path in said atomizer whereby no electrically conductive water film can be formed between said body and said atomizer.

3. A device according to claim 1 wherein said high voltage source includes a ground connection, said atomizer including at least one electrically conducting portion and said electrically conducting portion connected to said ground connection.

4. A device according to claim 1 further including a separate resistor connected between each of said charging electrodes and said voltage source, each of said separate resistors disposed within said body bounding said passage.

5. A device as claimed in claim 1 wherein said atomizer comprises a spray nozzle having a spray discharge, said body disposed adjacent said spray discharge, means for moving the objects to be moistened and/or discharged through a path presenting them at spaced relationship to the outlet opening of said body, and a counterelectrode arranged behind the objects, said high voltage source having first and second terminals of different charge, one of said terminals being connected to said charging electrode in said body passage and the other being connected to said counterelectrode, said high voltage source supplying said charging and counterelectrodes with voltages which are oppositely polarized relative to the ground.

6. A device as claimed in claim 5, wherein said counterelectrode comprises a plate having a boundary surface which is smooth so as to prevent a point discharge.

7. A device as claimed in claim 1, wherein said atomizer comprises a spray tube directed upwardly and having a discharge directed outwardly, said body disposed adjacent to but spaced from said spray tube discharge, the space between said body and said spray tube discharge providing a gap so that no electrically conducting liquid film can form between said spray tube and said body.

8. A device for moistening and/or discharging electrically insulating objects and materials, in particular webs and sheets of paper and plastic, comprising: an atomizer for atomizing water to produce droplets; a body having a passage therethrough for receiving the atomized water and having an outlet opening; a plurality of sharp charging electrodes extending into the passage of said body for charging the droplets and for forming a cloud in the area of said charging electrodes; said body including an electrically insulating wall surface bounding said passage in at least the area of said charging electrodes and said outlet opening; and a high voltage source connected to said charging electrodes for charging the droplets; said atomizer comprising a spray tube having an upwardly extending portion and an outwardly extending portion with the cross sectional area of said outwardly extending portion being chosen to reduce a flow of velocity of the atomized water to an extent causing larger heavier droplets to fall out of a flow path of the atomized water, said atomizer further comprising a spray nozzle having a discharge directed toward said spray tube, a housing defining an atomizer chamber around said spray nozzle, means for feeding water into said chamber, said spray nozzle picking up water during operation, means for directing air into said chamber to produce a flow of liquid in a spray to form the atomized water passing into said spray tube.

9. A method of moistening and/or discharging electrically insulating objects and materials, in particular webs and sheets of paper and plastic, comprising the steps of forming a quantity of water into a spray of atomized water, directing the spray of atomized water through a passageway for causing larger heavier droplets of water in the spary to fall out of the spray, directing the spray into a passage extending through a body spaced from the passageway, subjecting the spray in the body to a corona discharge to produce a charge on the droplets of the spray of atomized water by using a plurality of sharp charging electrodes extending into the passage of the body, and directing the charged droplets through an outlet opening of the body toward the objects and materials to be moistened and/or discharged.

10. A method as claimed in claim 9, wherein the spray is charged by electrodes at a voltage of 20 kV at most, relative to ground.

11. A method as claimed in claim 9, using both an electrode and a counterelectrode and applying a voltage to the counterelectrode having a polarity relative to ground which is opposite to that applied to the charging electrode and, wherein, the charged droplets are attracted by the counterelectrode toward the object to be coated.

12. A method as claimed in claim 9, wherein two different charging electrodes are employed and including applying voltages of opposite polarities to the respective charging electrodes and, wherein, the objects to be discharged are moved past the path of the spray on a conveyor to which a ground potential is applied.

13. A method as claimed in claim 9, wherein the charging electrode has a diameter of 0.005 mm at most.

14. A method as claimed in claim 9, wherein the spray is moved past the charging electrode with the electrodes unconnected at a velocity of 20 cm/s maximum.

* * * * *